US010865627B2

(12) United States Patent
Al-Zahrani

(10) Patent No.: US 10,865,627 B2
(45) Date of Patent: Dec. 15, 2020

(54) SHROUDED ELECTRICAL SUBMERSIBLE PUMP

(71) Applicant: SAUDI ARABIAN OIL COMPANY, Dhahran (SA)

(72) Inventor: Abdullah M. Al-Zahrani, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 15/421,665

(22) Filed: Feb. 1, 2017

(65) Prior Publication Data

US 2018/0216447 A1 Aug. 2, 2018

(51) Int. Cl.

| | |
|---|---|
| ***E21B 43/12*** | (2006.01) |
| ***E21B 33/12*** | (2006.01) |
| ***E21B 34/06*** | (2006.01) |

(52) U.S. Cl.

CPC ..... *E21B 43/128* (2013.01); *E21B 33/12* (2013.01); *E21B 34/06* (2013.01)

(58) Field of Classification Search

CPC ..... E21B 43/128; E21B 43/121; F04B 47/06
See application file for complete search history.

(56) References Cited

U.S. PATENT DOCUMENTS

| | | | | |
|---|---|---|---|---|
| 3,508,188 | A | 4/1970 | Buck | |
| 4,537,257 | A * | 8/1985 | Todd | E21B 43/128 166/106 |
| 6,089,322 | A * | 7/2000 | Kelley | E21B 43/38 166/105.5 |
| 6,325,143 | B1 * | 12/2001 | Scarsdale | E21B 43/128 166/106 |
| 6,457,531 | B1 | 10/2002 | Bangash et al. | |
| 6,595,295 | B1 | 7/2003 | Berry et al. | |
| 7,543,643 | B2 | 6/2009 | Hill | |
| 8,316,949 | B2 | 11/2012 | Rooks | |
| 8,448,699 | B2 * | 5/2013 | Camilleri | E21B 43/128 166/369 |
| 8,708,727 | B2 | 4/2014 | Spahi et al. | |
| 8,950,476 | B2 | 2/2015 | Head | |
| 8,968,018 | B2 | 3/2015 | Sivik et al. | |
| 9,175,692 | B2 | 11/2015 | Nowitzki et al. | |

(Continued)

FOREIGN PATENT DOCUMENTS

| | | |
|---|---|---|
| FR | 2578587 A1 | 9/1986 |
| GB | 2345307 A | 7/2000 |

(Continued)

OTHER PUBLICATIONS

International Search Report and Written Opinion for related PCT application PCT/US2017/047698 dated Feb. 2, 2018.

(Continued)

*Primary Examiner* — Giovanna Wright
(74) *Attorney, Agent, or Firm* — Bracewell LLP; Constance G. Rhebergen; Linda L. Morgan

(57) ABSTRACT

A system for producing hydrocarbons from a subterranean well includes an electrical submersible pump assembly with a motor, a seal section, and a pump. A packer assembly with a mechanical valve is retrievable with the electrical submersible pump assembly and is a primary high pressure mechanical barrier. A shroud fully encapsulates the electrical submersible pump assembly. An annular seal assembly seals around an outer diameter of the shroud, the shroud and the annular seal assembly together being a secondary high pressure mechanical barrier.

16 Claims, 3 Drawing Sheets

(56) References Cited

U.S. PATENT DOCUMENTS

| | | | | |
|---|---|---|---|---|
| 2002/0125014 | A1* | 9/2002 | Dearing | E21B 17/203 166/384 |
| 2006/0245957 | A1 | 11/2006 | Berry et al. | |
| 2009/0211753 | A1* | 8/2009 | Emtiazian | E21B 43/121 166/250.03 |
| 2010/0035452 | A1 | 2/2010 | Mudge, III et al. | |
| 2010/0142697 | A1 | 6/2010 | Bot et al. | |
| 2011/0186302 | A1* | 8/2011 | Coyle | E21B 43/121 166/372 |
| 2012/0012332 | A1 | 1/2012 | Rooks | |
| 2012/0049513 | A1 | 3/2012 | Herrera | |
| 2012/0117793 | A1 | 5/2012 | Beurthey et al. | |
| 2012/0181043 | A1* | 7/2012 | Patel | E21B 43/128 166/373 |
| 2014/0050603 | A1 | 2/2014 | Hoj | |
| 2015/0130185 | A1 | 5/2015 | Knapp | |
| 2015/0255974 | A1 | 9/2015 | Burrow et al. | |
| 2016/0024854 | A1 | 1/2016 | Clingman et al. | |
| 2016/0290063 | A1 | 10/2016 | Richards | |
| 2017/0254172 | A1* | 9/2017 | Mack | E21B 43/128 |

FOREIGN PATENT DOCUMENTS

| | | | |
|---|---|---|---|
| WO | WO2006031478 | A1 | 3/2006 |
| WO | WO2015199550 | A2 | 12/2015 |

OTHER PUBLICATIONS

International Search Report and Written Opinion for related PCT application PCT/US2018/016363 dated May 3, 2018.

* cited by examiner

SHROUDED ELECTRICAL SUBMERSIBLE PUMP

BACKGROUND OF THE DISCLOSURE

1. Field of the Disclosure

The disclosure relates generally to electrical submersible pumps and in particular, to electrical submersible pump assemblies with shrouds.

2. Description of the Related Art

One method of producing hydrocarbon fluid from a well bore that lacks sufficient internal pressure for natural production is to utilize an artificial lift method such as an electrical submersible pump. A string of tubing or pipe known as a production string suspends the submersible pumping device near the bottom of the well bore proximate to the producing formation. The submersible pumping device is operable to retrieve production zone fluid, impart a higher pressure into the fluid and discharge the pressurized production zone fluid into production tubing. Pressurized well bore fluid rises towards the surface motivated by difference in pressure. Electrical submersible pumps can be useful, for example, in high gas/oil ratio operations and in aged fields where there is a loss of energy and the hydrocarbons can no longer reach the surface naturally.

Current electrical submersible pumps are manufactured in three major parts which are: motor, seal section and pump. A current common deployment method is to install the electrical submersible pump with a rig. In order to provide for a double barrier, which is required practice by certain operators, upper and lower packers or a lower packer and an upper plug can be used. However, upper packers or plugs can require additional expensive rig time and equipment to install. When pulling an electrical submersible pump, upper packers or plugs can become stuck and lead to even further additional expensive rig time to remove. Also, having an upper packer or plug can require an upper splice of the cable providing power to the electrical submersible pump assembly, increasing the risk of a weak power connection.

SUMMARY OF THE DISCLOSURE

Embodiments disclosed herein provide an electrical submersible pump assembly that has a motor, seal section and pump that are fully encapsulated within a shroud that is pressure qualified to be a mechanical barrier. The shroud can act as a secondary high pressure barrier with a packer assembly acting as a primary high pressure mechanical barrier. Therefore, no upper packer or plug is required. The electrical submersible pump assembly can be put together by two operators and deployed rig-less with coiled tubing. The production fluids are produced through the coiled tubing. Systems and methods disclosed herein are simple to assemble and deploy relative to some current systems, which reduces human error and saves on costs.

In an embodiment of this disclosure, a system for producing hydrocarbons from a subterranean well includes an electrical submersible pump assembly with a motor, a seal section, and a pump. A packer assembly with a mechanical valve is retrievable with the electrical submersible pump assembly and is a primary high pressure mechanical barrier. A shroud fully encapsulates the electrical submersible pump assembly. An annular seal assembly seals around an outer diameter of the shroud, the shroud and the annular seal assembly together being a secondary high pressure mechanical barrier.

In alternate embodiments, coiled tubing can be connected to the electrical submersible pump assembly, the coiled tubing supporting the electrical submersible pump assembly and the shroud. A discharge of the electrical submersible pump assembly can be directed into a coiled tubing providing fluid communication between the electrical submersible pump assembly and a wellhead assembly. The system can further include a well tubing, wherein the annular seal assembly is operable to form a seal with an inner diameter of the well tubing. The packer assembly and the shroud can be located within the well tubing and the packer assembly can be located farther from a wellhead assembly than the electrical submersible pump assembly is located from the wellhead assembly.

In other alternate embodiments, a tail pipe of the shroud can extend into the packer assembly. A power cable can extend within the subterranean well to the shroud, the power cable having a sealed termination at the shroud.

In an alternate embodiment of this disclosure, a system for producing hydrocarbons from a subterranean well includes a well tubing extending into the subterranean well. An electrical submersible pump assembly with a motor, a seal section, and a pump is located within the well tubing. The system also includes a packer assembly with a mechanical valve, the packer assembly sealing with an inner diameter surface of the well tubing and retrievable with the electrical submersible pump assembly, and being a primary high pressure mechanical barrier. A shroud fully encapsulates the electrical submersible pump assembly. An annular seal assembly seals between an outer diameter of the shroud and the inner diameter surface of the well tubing, the shroud and annular seal together being a secondary high pressure mechanical barrier.

In alternate embodiments, the packer assembly and the annular seal assembly can include a central bore providing fluid communication between the subterranean well below the packer assembly and the electrical submersible pump assembly. An upper power cable can extend within the subterranean well to the shroud, the upper power cable having a sealed termination at the shroud. A lower power cable can extend from the upper power cable to the motor.

In other alternate embodiments, a coiled tubing can support the electrical submersible pump assembly and the shroud while lowering and raising the electrical submersible pump assembly within the subterranean well. A discharge of the electrical submersible pump assembly can be directed into a coiled tubing providing fluid communication between the electrical submersible pump assembly and a wellhead assembly. A tubing casing annulus can be located between the outer diameter of the shroud and an outer diameter of a coiled tubing, the inner diameter surface of the well tubing and axially above the packer assembly to a wellhead assembly and can be sealed from production fluids.

In another embodiment of this disclosure, a method for producing hydrocarbons from a subterranean well with an electrical submersible pump assembly includes providing the electrical submersible pump assembly with a motor, a seal section, and a pump. The electrical submersible pump assembly is fully encapsulated with a shroud. A packer assembly is installed with a mechanical valve within the subterranean well, the packer assembly retrievable with the electrical submersible pump assembly and being a primary high pressure mechanical barrier. An annular seal assembly sealing around an outer diameter of the shroud is provided, the shroud and annular seal together being a secondary high pressure mechanical barrier.

In alternate embodiments, the method can further include lowering the electrical submersible pump assembly into the subterranean well with coiled tubing, the coiled tubing supporting the electrical submersible pump assembly and the shroud. Produced fluids can be discharged with the electrical submersible pump assembly into a coiled tubing, the coiled tubing providing fluid communication between the electrical submersible pump assembly and a wellhead assembly.

In alternate embodiments, the method can include forming a seal between an inner diameter of a well tubing and the outer diameter of the shroud with the annular seal assembly. Fluid communication can be provided between the subterranean well below the packer assembly and the electrical submersible pump assembly through a central bore of the packer assembly and the annular seal assembly. The motor of the electrical submersible pump assembly can be powered with an upper power cable extending within the subterranean well to the shroud and a lower power cable extending from the upper power cable to the motor. A tubing casing annulus located between the outer diameter of the shroud and an outer diameter of a coiled tubing, an inner diameter of a well tubing and axially above the packer assembly to a wellhead assembly can be filled with brine, wherein the tubing casing annulus is sealed from production fluids.

BRIEF DESCRIPTION OF THE DRAWINGS

So that the manner in which the above-recited features, aspects and advantages of the embodiments of this disclosure, as well as others that will become apparent, are attained and can be understood in detail, a more particular description of the disclosure briefly summarized above may be had by reference to the embodiments thereof that are illustrated in the drawings that form a part of this specification. It is to be noted, however, that the appended drawings illustrate only preferred embodiments of the disclosure and are, therefore, not to be considered limiting of the disclosure's scope, for the disclosure may admit to other equally effective embodiments.

DETAILED DESCRIPTION

Embodiments of the present disclosure will now be described more fully hereinafter with reference to the accompanying drawings which illustrate embodiments of the disclosure. Systems and methods of this disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout, and the prime notation, if used, indicates similar elements in alternative embodiments or positions.

In the following discussion, numerous specific details are set forth to provide a thorough understanding of the present disclosure. However, it will be obvious to those skilled in the art that embodiments of the present disclosure can be practiced without such specific details. Additionally, for the most part, details concerning well drilling, reservoir testing, well completion and the like have been omitted inasmuch as such details are not considered necessary to obtain a complete understanding of the present disclosure, and are considered to be within the skills of persons skilled in the relevant art.

Figure 1:
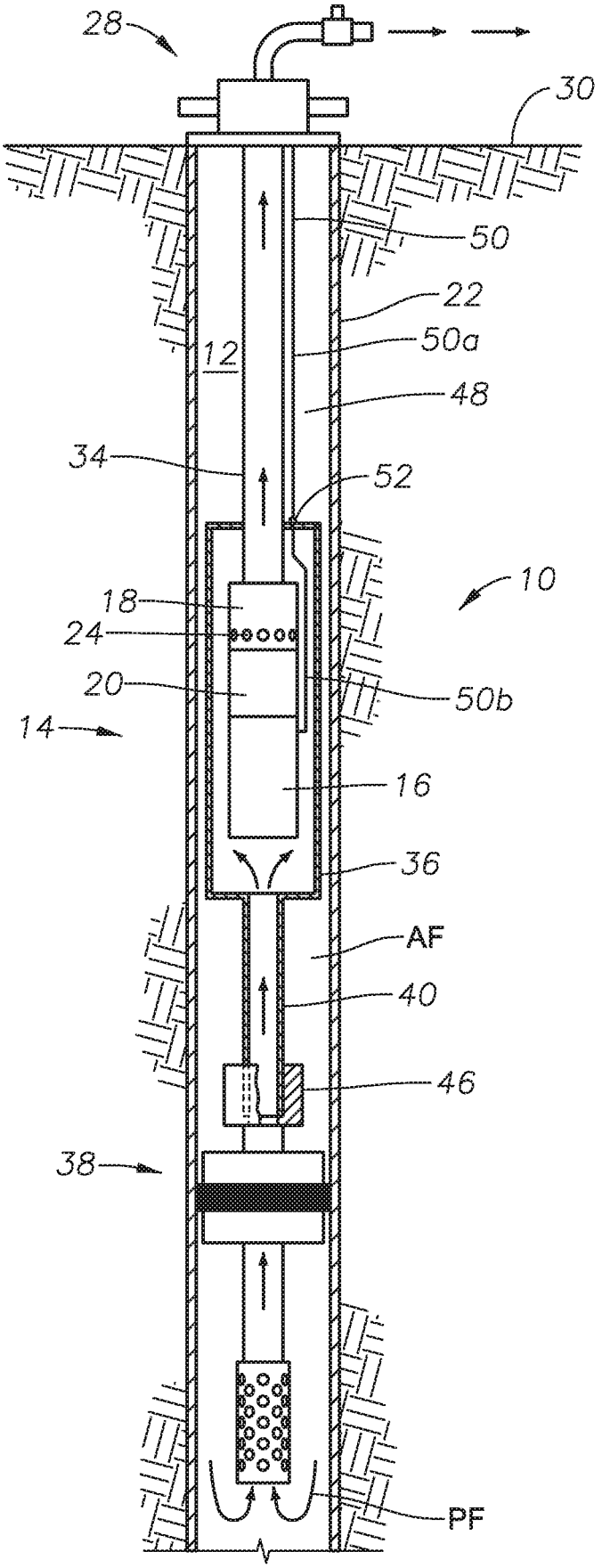
FIG. 1 is a section view of a subterranean well having an electrical submersible pump assembly, in accordance with an embodiment of this disclosure.
Figure 2:
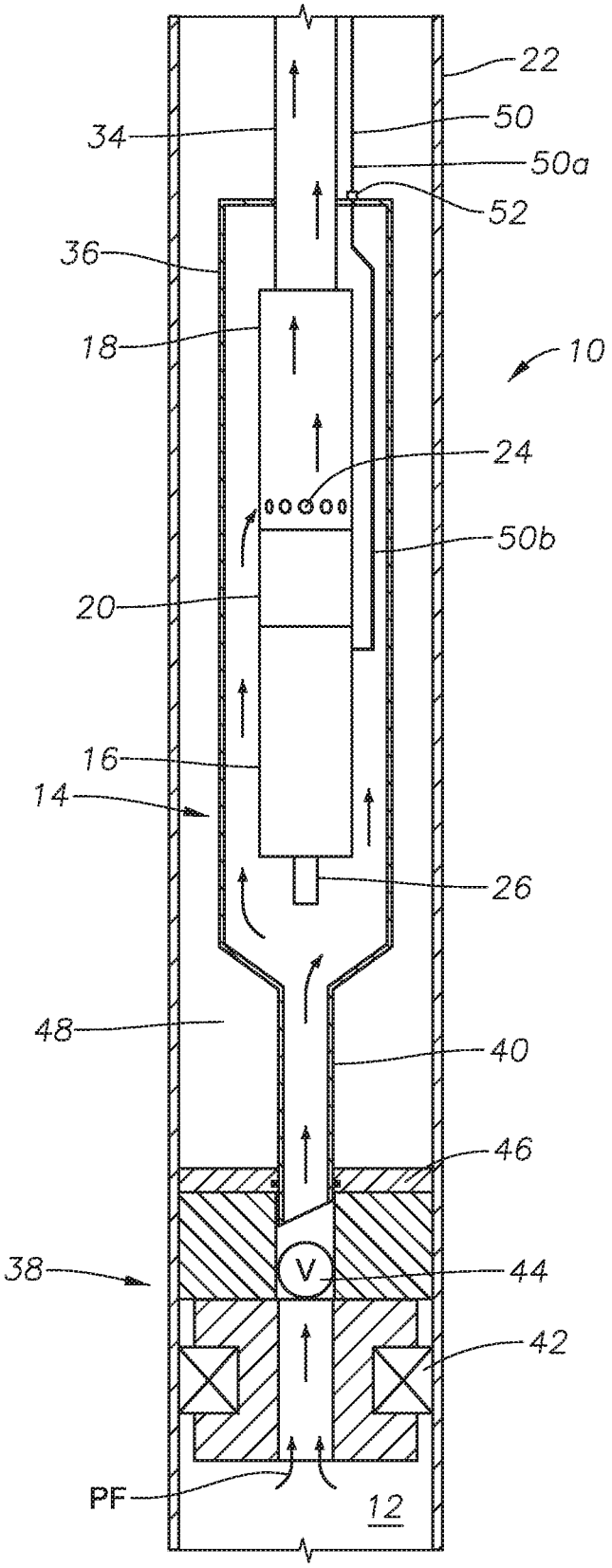
FIG. 2 is a section view of a subterranean well having an electrical submersible pump assembly, in accordance with an embodiment of this disclosure

Looking at FIGS. 1-2, subterranean well 10 includes wellbore 12. Electrical submersible pump assembly 14 is located within wellbore 12. Wellbore 12 can include well tubing 22, which can be, for example, a well casing or other large diameter well tubing. Electrical submersible pump assembly 14 of FIG. 1 includes motor 16 on its lowermost end which is used to drive a pump 18 at an upper portion of electrical submersible pump assembly 14. Between motor 16 and pump 18 is seal section 20 for equalizing pressure within electrical submersible pump assembly 14 with that of wellbore 12.

Sensor 26 can be included in electrical submersible pump assembly 14. In the example embodiment of FIG. 1, sensor 26 is located at a lower end of motor 16. Sensor 26 can gather and provide data relating to operations of electrical submersible pump assembly 14 and conditions within wellbore 12. As an example, sensor 26 can monitor and report pump 18 intake pressure and temperature, pump 18 discharge pressure and temperature, motor 16 oil and motor 16 winding temperature, vibration of electrical submersible pump assembly 14 in multiple axis, and any leakage of electrical submersible pump assembly 14.

Production fluid PF is shown entering wellbore 12 from a formation adjacent wellbore 12. Production fluid PF flows to inlet 24 formed in the housing of pump 18. Production fluid PF is pressurized within pump 18 and travels up to wellhead assembly 28 at surface 30 through coiled tubing 34. Electrical submersible pump assembly 14 is suspended within wellbore 12 with coiled tubing 34. Coiled tubing 34 is an elongated tubular member that extends within subterranean well 10. Coiled tubing 34 can be formed of carbon steel material, carbon fiber tube, or other types of corrosion resistance alloys or coatings.

Electrical submersible pump assembly 14 is fully encapsulated within shroud 36. Shroud 36 is designed to withstand high pressures so that shroud 36 can act as a mechanical barrier for preventing production fluids PF from reaching surface 30. As an example, shroud 36 can be designed to contain pressures up to 5000 psi. It is desirable to have two separate barriers between production fluids PF and surface 30 to provide increased system safety. Double barriers can be particularly important while retrieving electrical submersible pump assembly 14. Embodiments of this disclosure provide a double mechanical barrier during retrieval of electrical submersible pump assembly 14 with coiled tubing 34. Shroud 36 can act as a secondary high pressure barrier with a packer assembly 38 acting as a primary high pressure mechanical barrier.

Shroud 36 has an upper end that is attached to and in fluid communication with coiled tubing 34. A discharge of electrical submersible pump assembly 14 is directed into coiled tubing 34 providing fluid communication between electrical submersible pump assembly 14 and wellhead assembly 28. Because production fluid PF is produced through coiled tubing 34, there is no outlet releasing fluids within electrical submersible pump assembly 14 into wellbore 12 and production fluids are not produced through the tubing casing annulus 48. Tubing casing annulus 48 is an annular space located between the outer diameter of shroud 36 and an outer diameter of coiled tubing 34, and the inner diameter of well tubing 22. Tubing casing annulus 48 is axially limited by packer assembly 38 or seal assembly 46 at a lower end and axially limited at an upper end below wellhead assembly 28.

A lower end of shroud 36 has tail pipe 40. Tail pipe 40 can extend into packer assembly 38 and be in fluid communication with production fluids PF located axially below packer assembly 38. Packer assembly 38 is set within subterranean well 10 axially below electrical submersible pump assembly 14 so that packer assembly 38 is located farther from wellhead assembly 28 than shroud 36 is located from wellhead assembly 28.

Power cable 50 extends through wellbore 12 alongside coiled tubing 34. Power cable 50 can provide the power required to operate motor 16 of electrical submersible pump assembly 14. In order to power electrical submersible pump 14 an upper power cable 50*a* portion of power cable 50 extends within subterranean well 10 to shroud 36. Power cable 50 has a sealed termination 52 at shroud 36. For example, sealed termination 52 can include a metal seal. Lower power cable 50*b* portion of power cable 50 extends from the sealed termination 52 of upper power cable 50*a* to motor 16. Power cable 50 can be a suitable power cable for powering an electrical submersible pump assembly 14, known to those with skill in the art.

Packer assembly 38 includes packer 42 and mechanical valve 44. Packer 42 has an outer diameter that seals with an inner diameter of well tubing 22. Packer 42 can be a traditional packer member know in the art and set in a typical way. In the example of FIG. 2, packer 42 is the lowermost element of packer assembly 38. Packer 42 has a central bore that provides a fluid flow path through packer 42.

Mechanical valve 44 can be for example, a ball valve or other known subsea valve that can prevent high pressure fluids within wellbore 12 from passing through mechanical valve 44 when mechanical valve 44 is in the closed position. In an open position, mechanical valve 44 has a central bore that provides a fluid flow path through mechanical valve 44. Mechanical valve 44 sealingly engages the inner diameter of well tubing 22.

Figure 3:
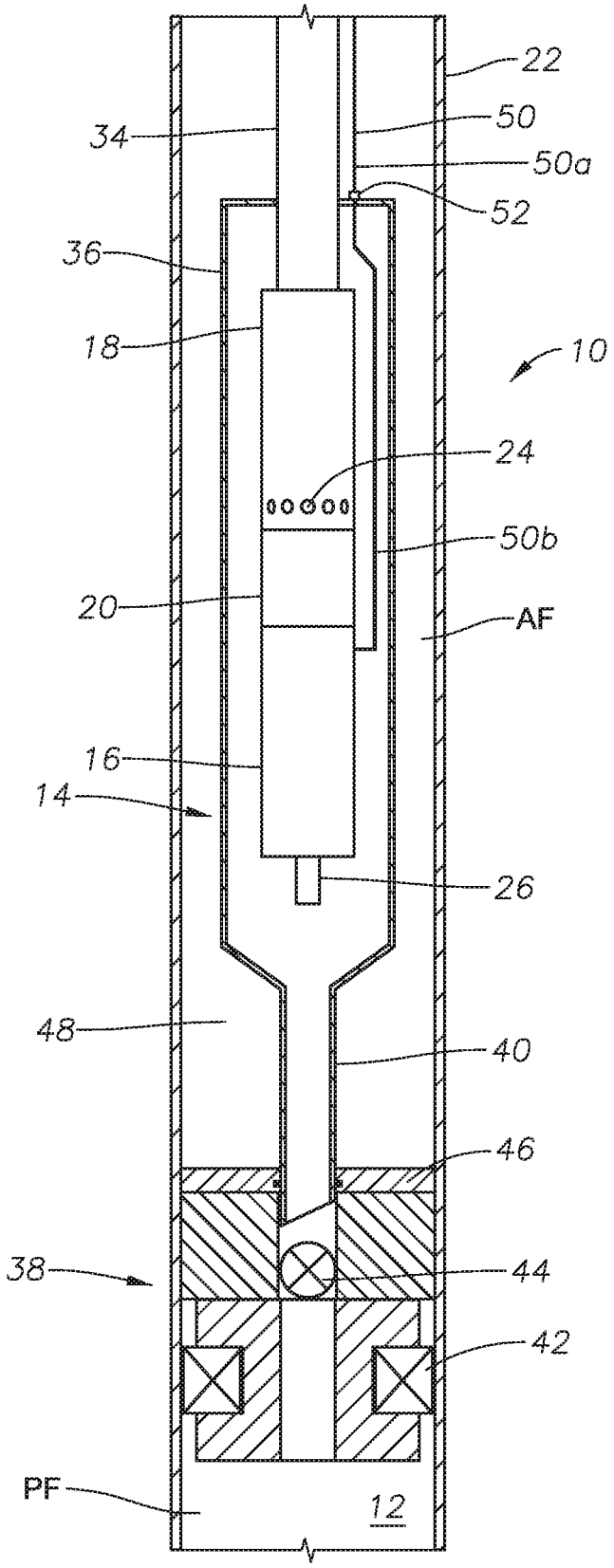
FIG. 3 is a section view of a subterranean well having an electrical submersible pump assembly, in accordance with an embodiment of this disclosure, shown with the mechanical valve in a closed position.

Packer assembly 38 is retrievable with electrical submersible pump assembly 14 so that as electrical submersible pump assembly 14 is pulled out of subterranean well 10 with coiled tubing 34, packer assembly 38 will remain secured to electrical submersible pump assembly 14. With mechanical valve 44 in the closed position, as shown in FIG. 3, annulus fluids AF will be trapped above packer assembly 38 as electrical submersible pump assembly 14 is pulled out of subterranean well 10. Annulus fluids AF can be, for example, a brine or other known for use in a tubing casing annulus 48. Packer assembly 38 is designed to contain the pressures of wellbore 12 so that packer assembly 38 is a primary high pressure mechanical barrier.

Seal assembly 46 can be associated with packer assembly 38 or can be a separate independent element. Seal assembly 46 includes an annular shaped member that surrounds a portion of shroud 36. A central bore of seal assembly 46 provides fluid communication between subterranean well 10 below packer assembly 38 and electrical submersible pump assembly 14. When in an engaged position (FIG. 2), an outer diameter of seal assembly 46 engages and forms a seal with the inner diameter of well tubing 22. When seal assembly 46 is in an engaged position, shroud 36 and annular seal assembly 46 together form a secondary high pressure mechanical barrier. For example, if mechanical valve 44 was to leak or fail, tubing casing annulus 48 will remain sealed from production fluids PF by shroud 36 and seal assembly 46. Therefore embodiments of this disclosure provide two mechanical barriers for preventing production fluids PF from entering tubing casing annulus 48 during the operation and removal of electrical submersible pump assembly 14, without the need to run plugs or have a packer located axially above the electrical submersible pump assembly 14.

In an example of operation, packer assembly 38 can be set within well tubing 22. Electrical submersible pump assembly 14, fully encapsulated within shroud 36, can be run in well tubing 22 on coiled tubing 34. Coiled tubing 34 can support electrical submersible pump assembly 14 and shroud 36. Lowering electrical submersible pump assembly 14 and shroud 36 within well tubing 22 until a tail pipe of shroud 36 is located within packer assembly 38. Production fluids PF can be produced through the central bore of packer assembly 38 and seal assembly 46 and into shroud 36. Production fluid PF are artificially lifted by electrical submersible pump assembly 14 and produced to wellhead assembly 28 through coiled tubing 34. Gas within production fluids PF will enter shroud 36 with liquid elements of production fluids PF. Gas components of production fluids PF can be forced to be dissolved in the liquid within shroud 36 before entering pump 18, reducing gas locking of pump 18, increasing the efficiency of pump 18, and reducing potential damage or failure of electrical submersible pump assembly 14. If electrical submersible pump assembly 14 has to be pulled out for any reason, electrical submersible pump assembly 14 can be retrieved safely with coiled tubing 34.

While electrical submersible pump assembly 14 is being pulled out of well tubing 22, tubing casing annulus 48 can be filled with annulus fluid AF and dual mechanical barriers prevent production fluids PF from reaching tubing casing annulus 48. Packer assembly 38 can be the primary high pressure mechanical barrier and shroud 36 with seal assembly 46 can be the secondary high pressure mechanical barrier.

Systems and method of this disclosure therefore provide rigless installation and removal of an electrical submersible pump assembly 14 on coiled tubing 34. The encapsulation of the electrical submersible pump assembly 14 within shroud 36 together with the packer assembly 38 provides dual mechanical barriers without and upper packer or plug.

Therefore, as disclosed herein, embodiments of the systems and methods of this disclosure will provide cost savings relative to current electrical submersible pumping assemblies due to simpler and faster installation operations which can be handled rig-less by only two crew members. Embodiments of this disclosure can be deployed in a variety of well types, including those with either high or low gas oil ratios. Systems and methods herein can reduce well downtime and human errors and provide for efficient workovers and improve production retention.

Embodiments of the disclosure described herein, therefore, are well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for producing hydrocarbons from a subterranean well, the system including:

an electrical submersible pump assembly with a motor, a seal section, and a pump;

a packer assembly with a mechanical valve, the packer assembly having a packer sealing with an inner diameter surface of a well tubing and being a primary high pressure mechanical barrier, and further where the mechanical valve sealingly engages the inner diameter surface of the well tubing;

a shroud fully encapsulating the electrical submersible pump assembly, the shroud assembly operable to dissolve a gas component within a liquid component of the hydrocarbons to form a production fluid;

an annular seal assembly sealing around an outer diameter of the shroud, the shroud and the annular seal assembly together being a secondary high pressure mechanical barrier; and coiled tubing connected to the electrical submersible pump assembly and the shroud, the coiled tubing supporting the electrical submersible pump assembly and the shroud and being operable to riglessly install and remove the electrical submersible pump assembly and the shroud, and further being operable to deliver the production fluid to the wellhead assembly where the production fluid is all of the hydrocarbons that are delivered to the wellhead assembly; where a discharge of the electrical submersible pump assembly is directed into the coiled tubing, the coiled tubing providing fluid communication between the electrical submersible pump assembly and a wellhead assembly for the production fluid.

2. The system of claim 1, wherein the annular seal assembly is operable to form a seal with an inner diameter of the well tubing.

3. The system of claim 1, further comprising a tail pipe of the shroud, the tail pipe extending into the packer assembly.

4. The system of claim 1, wherein the packer assembly and the shroud are located within the well tubing and the packer assembly is located farther from a wellhead assembly than the electrical submersible pump assembly is located from the wellhead assembly.

5. The system of claim 1, further including a power cable extending within the subterranean well to the shroud, the power cable having a sealed termination at the shroud.

6. A system for producing hydrocarbons from a subterranean well, the system including:

a well tubing extending into the subterranean well;

an electrical submersible pump assembly with a motor, a seal section, and a pump located within the well tubing;

a packer assembly with a mechanical valve, the packer assembly having a packer sealing with an inner diameter surface of the well tubing and being a primary high pressure mechanical barrier, and further where the mechanical valve sealingly engages the inner diameter surface of the well tubing;

a shroud fully encapsulating the electrical submersible pump assembly, the shroud assembly operable to dissolve a gas component within a liquid component of the hydrocarbons to form a production fluid;

an annular seal assembly sealing between an outer diameter of the shroud and the inner diameter surface of the well tubing, the shroud and annular seal together being a secondary high pressure mechanical barrier; and coiled tubing connected to the electrical submersible pump assembly and the shroud, the coiled tubing supporting the electrical submersible pump assembly and the shroud and being operable to riglessly install and remove the electrical submersible pump assembly and the shroud, and further being operable to deliver the production fluid to the wellhead assembly where the production fluid is all of the hydrocarbons that are delivered to the wellhead assembly; where a discharge of the electrical submersible pump assembly is directed into the coiled tubing, the coiled tubing providing fluid communication between the electrical submersible pump assembly and a wellhead assembly for the production fluid.

7. The system of claim 6, wherein the packer assembly and the annular seal assembly include a central bore providing fluid communication between the subterranean well below the packer assembly and the electrical submersible pump assembly.

8. The system of claim 6, including an upper power cable extending within the subterranean well to the shroud, the upper power cable having a sealed termination at the shroud.

9. The system of claim 8, including a lower power cable extending from the upper power cable to the motor.

10. The system of claim 6, wherein the coiled tubing supports the electrical submersible pump assembly and the shroud while lowering and raising the electrical submersible pump assembly within the subterranean well.

11. The system of claim 6, wherein a tubing casing annulus located between the outer diameter of the shroud and an outer diameter of the coiled tubing, the inner diameter surface of the well tubing and axially above the packer assembly to a wellhead assembly is sealed from production fluids.

12. A method for producing hydrocarbons from a subterranean well with an electrical submersible pump assembly, the method including:

providing the electrical submersible pump assembly with a motor, a seal section, and a pump;

fully encapsulating the electrical submersible pump assembly with a shroud;

installing a packer assembly with a mechanical valve within the subterranean well, the packer assembly having a packer sealing with an inner diameter surface of a well tubing and being a primary high pressure mechanical barrier, and further where the mechanical valve sealingly engages the inner diameter surface of the well tubing;

providing an annular seal assembly sealing around an outer diameter of the shroud, the shroud and annular seal together being a secondary high pressure mechanical barrier;

riglessly installing the electrical submersible pump assembly and the shroud with a coiled tubing into the subterranean well, the coiled tubing supporting the electrical submersible pump assembly and the shroud within the subterranean well and being operable to riglessly remove the electrical submersible pump assembly and the shroud from the subterranean well; and dissolving a gas component within a liquid component of the hydrocarbons to form a production fluid within the shroud;

discharging the production fluid with the electrical submersible pump assembly into the coiled tubing, the coiled tubing providing fluid communication between the electrical submersible pump assembly and a wellhead assembly, the coiled tubing delivering the production fluid to the wellhead assembly, where the production fluid is all of the hydrocarbons that are delivered to the wellhead assembly from the electrical submersible pump.

13. The method of claim 12, further including forming a seal between an inner diameter of the well tubing and the outer diameter of the shroud with the annular seal assembly.

14. The method of claim 12, further including providing fluid communication between the subterranean well below the packer assembly and the electrical submersible pump assembly through a central bore of the packer assembly and the annular seal assembly.

15. The method of claim 12, further including powering the motor of the electrical submersible pump assembly with an upper power cable extending within the subterranean well to the shroud and a lower power cable extending from the upper power cable to the motor.

16. The method of claim 12, further including filling a tubing casing annulus located between the outer diameter of the shroud and an outer diameter of a coiled tubing, an inner diameter of the well tubing and axially above the packer assembly to a wellhead assembly with brine, wherein the tubing casing annulus is sealed from production fluids.

* * * * *